US008844614B2

(12) United States Patent
Brown et al.

(10) Patent No.: US 8,844,614 B2
(45) Date of Patent: Sep. 30, 2014

(54) TANGENTIAL PERFORATION SYSTEM

(76) Inventors: Donn J. Brown, Broken Arrow, OK (US); Brown L. Wilson, Tulsa, OK (US)

( * ) Notice: Subject to any disclaimer, the term of this patent is extended or adjusted under 35 U.S.C. 154(b) by 296 days.

(21) Appl. No.: 13/136,694

(22) Filed: Aug. 8, 2011

(65) Prior Publication Data

US 2013/0037264 A1 Feb. 14, 2013

(51) Int. Cl.

| | |
|---|---|
| ***E21B 43/11*** | (2006.01) |
| ***E21B 43/116*** | (2006.01) |
| ***E21B 43/119*** | (2006.01) |
| ***E21B 43/38*** | (2006.01) |

(52) U.S. Cl.

CPC ..... *E21B 43/119* (2013.01); *E21B 43/38* (2013.01)

USPC ..... 166/55.2; 166/297

(58) Field of Classification Search

USPC ..... 166/297, 298, 55, 55.1, 55.2

See application file for complete search history.

(56) References Cited

U.S. PATENT DOCUMENTS

| | | | | |
|---|---|---|---|---|
| 2002/0096327 | A1* | 7/2002 | Kobylinski et al. | 166/265 |
| 2006/0118303 | A1* | 6/2006 | Schultz et al. | 166/297 |
| 2007/0034375 | A1* | 2/2007 | Vella et al. | 166/298 |

* cited by examiner

*Primary Examiner* — Brad Harcourt

(57) ABSTRACT

A method to separate a gas phase from a liquid phase in a subterranean formation that includes positioning a downhole tool in a wellbore, operating the downhole tool to form perforations in the subterranean formation in a manner that creates cyclonic motion in fluids that exit the subterranean formation and enter the wellbore through the perforations, the fluid having a gas phase and a liquid phase, and producing the liquid phase to the surface, whereby the liquid phase is substantially devoid of the gas phase as a result of the cyclonic motion.

9 Claims, 6 Drawing Sheets

TANGENTIAL PERFORATION SYSTEM

BACKGROUND OF DISCLOSURE

1. Field of the Disclosure

Embodiments of the present disclosure relate generally to apparatuses and systems used to perforate a subterranean formation, and methods of using the same. Other embodiments relate to perforation of a subterranean formation in order to induce and/or facilitate downhole separation of subterranean fluids produced therefrom.

2. Background Art

Once a wellbore is drilled into a formation with conventional drilling methods, the wellbore is usually completed by positioning a casing string within the wellbore. The casing string increases the integrity of the wellbore, and also provides a path to the surface for fluids to flow from the formation to the surface. The casing string is normally made up of individual lengths of relatively large diameter tubulars that are secured together by any suitable method known to one of skill in the art, such as screw threads or welds.

Typically, the casing string is cemented to the wellbore by circulating cement into the annulus defined between the casing string and the wellbore. The cemented casing string is subsequently perforated to establish fluid communication between the formation and the interior of the casing string so that the valuable fluids within the formation may be produced to the surface. Perforating has conventionally been performed by lowering a perforating gun (or other comparable device) down inside the casing string.

A perforating gun may be constructed to be of any length, and the gun is typically lowered within the casing on a wireline or other device to a point adjacent a zone of interest. Commonly, perforating guns are run into the wellbore via lines that also convey signals from the surface in order to fire the gun, and may include the use of coiled tubing or slicklines. Slicklines, which do not require surface communication to fire the gun, use a mechanism on the gun to fire the charges upon reaching, for example, a certain temperature, pressure, elapsed time, etc.

Once the gun is at a desired location, an explosive charge connected to the gun is detonated in order to penetrate or perforate one or more of the casing string, the wellbore, the formation, etc. A typical explosive charge may fire and result in a high-pressure, high-velocity jet that creates the perforation. The extremely high pressure and velocity of the jet cause materials, such as steel, cement, rock formations, etc. to flow plastically around the jet path, thereby forming the perforation. The perforations, including characteristics and configurations thereof, have significant influence on the productivity of the well. Thus, the choice and/or configuration of the perforating charge are of importance, including the direction of the resultant charge.

FIGS. 1A-1D together depict an example of a conventional perforation system and perforating tool 100. The perforation tool 100 may be positioned within a wellbore 102 adjacent to a casing string 104, which may be near a zone of interest within the formation 112. A tubestring 107 connected to a power source via wireline (not shown), or that has any other kind of operable detonation device, may be used to detonate one or more charges 106 mounted on the tool 100.

Typically, a perforation tool 100 may be, for example, thirty feet long with a series of charges 106, usually located on one or more sides of the tool 100. The design of the charges 106 depends on a number of factors, such as the type of formation, the desired production zone, the design of the zone, etc. The tool 100 may have charges 106 configured to provide, for example, one perforation per foot, one perforation per two feet, two perforations per foot, etc., and the charges 106 are usually spaced apart and mounted in such a way that the charges 106 are aimed toward the casing string 104 in order to shoot toward the casing. Upon firing, the charges 106 detonate and fire a fluid jet 109 (or other comparable discharge or propellant) in at least one outward radial direction 110 toward the casing 104, thereby creating perforations 114.

Previously, the location of the perforation(s) did not matter as long as fluids were produced from the formation. Typically, radial perforations are positioned as close as every six inches to about every two feet; however, this becomes problematic because close perforations interfere with the drain radius, as well as with each other. Fluids that enter the wellbore enter in an uncontrolled and violent/turbulent fashion into a small singular area that makes production of the fluids difficult.

To help production, a pump may be disposed below these perforations. However, when subterranean fluids are produced, there is usually gas and liquid mixed together, such that the liquid phase will often have small bubbles (i.e., gaseous phase) entrained in the liquid, which makes it extremely difficult to pump the liquid. In addition, it has been found that as fluid comes out of the perforations, the fluids are subject to immediate boiling in the wellbore, hence forming even more gas. As a result of a substantial amount of turbulence from conventional perforation and because of boiling, vast amounts of gas and bubbles end up being carried down in the liquid phase toward the pump.

The bubbles of the gas become very transient, in that the bubbles create pulsing and slugging in the well. Therefore, it becomes necessary to put the pump far enough down that pulsation does not reach the pump. Because the liquid may carry the gas down the wellbore to great depths, it is often necessary to place the pump at a distance greater than 1000 feet. Alternatively, or additionally, in order to separate bubbles it may become necessary to substantially slow production rates in order to guarantee minimal adequate separation from buoyant forces.

Sometimes it has been beneficial to provide an extra rotational force that promotes extra separation with the fluids. The rotational force causes, for example, bubbles to collect towards the center where the bubbles can grow in size. Larger bubbles are desired toward and in the center because larger bubbles have the tendency to lift their way through the liquid phase much more easily than the small bubbles.

Several attempts have been attempted to provide a mechanical rotational force within a wellbore. For example, some downhole devices, such as centrifuges or cyclones, try to get the liquid to swirl in order get a spinning effect and hopefully some separation of the gas. However, these devices are cumbersome within the wellbore, and are also problematic in that they do not provide sufficient swirling. Without sufficient swirling the gas cannot escape from the liquid, and the bubbles are carried down to the pump inlet.

Thus, there is a need to easily promote sufficient swirling of the formation fluids in the wellbore that is both economic and unencumbered. There is a need to increase production rates of fluids produced from perforated wellbores, as well as to reduce the length between perforations and downhole-disposed pumps. There is a great need to perforate a formation to induce subterranean fluids to enter tangentially, thereby creating a natural vortex and/or cyclonic motion. There is a need to separate formation fluids in order to easily produce liquids from a subterranean formation.

SUMMARY OF DISCLOSURE

Embodiments disclosed herein may provide a method of separating a gas phase from a liquid phase of a fluid in a subterranean formation. The method includes positioning a downhole tool in a wellbore, operating the downhole tool to form perforations in the subterranean formation in a manner that creates cyclonic motion in fluids that exit the subterranean formation and enter the wellbore through the perforations, the fluid having a gas phase and a liquid phase, and producing the liquid phase to the surface, whereby the liquid phase is substantially devoid of the gas phase.

Other embodiments may provide a method of perforating a subterranean formation that includes positioning a downhole tool in a wellbore, operating the downhole tool to perforate the subterranean formation, forming the perforations in a manner that creates a natural cyclonic motion as a result of the momentum of the fluid as the fluid exists the subterranean formation and enters the wellbore through the perforations, the fluid having a gas phase and a liquid phase, and producing the liquid phase to the surface, whereby, as a result of separation, the liquid phase is substantially devoid of the gas phase.

Embodiments of the present disclosure may provide a downhole tool usable for perforating a subterranean formation that includes a first perforating charge mounted near a first point on a perimeter of the downhole tool, such that the first perforating charge is configured to perforate the subterranean formation in a direction that is substantially parallel to a first tangent line that bisects the first point on the perimeter.

Another embodiment may provide a tangential perforation system for perforating a subterranean formation, the system including a wellbore disposed in the subterranean formation, a downhole tool positioned within the wellbore, whereby the downhole tool further includes a first perforating charge mounted near a first point on an outer circumference of the downhole tool, wherein the first perforating charge is configured to perforate a subterranean formation in a direction that is substantially parallel to a first tangent line that bisects the first point on the outer circumference.

Additional embodiments may provide a tangential perforation system for perforating a subterranean formation that includes a wellbore, and a downhole tool positioned within the wellbore. The downhole tool may include at least one perforating charge mounted along a lateral axis of the downhole tool, such that the at least one perforating charge is configured to perforate the wellbore and the subterranean formation in a direction that is substantially perpendicular to the lateral axis.

Other aspects and advantages of the disclosure will be apparent from the following description and the appended claims.

DETAILED DESCRIPTION

Figures 1A, 1B, 1C, 1D:
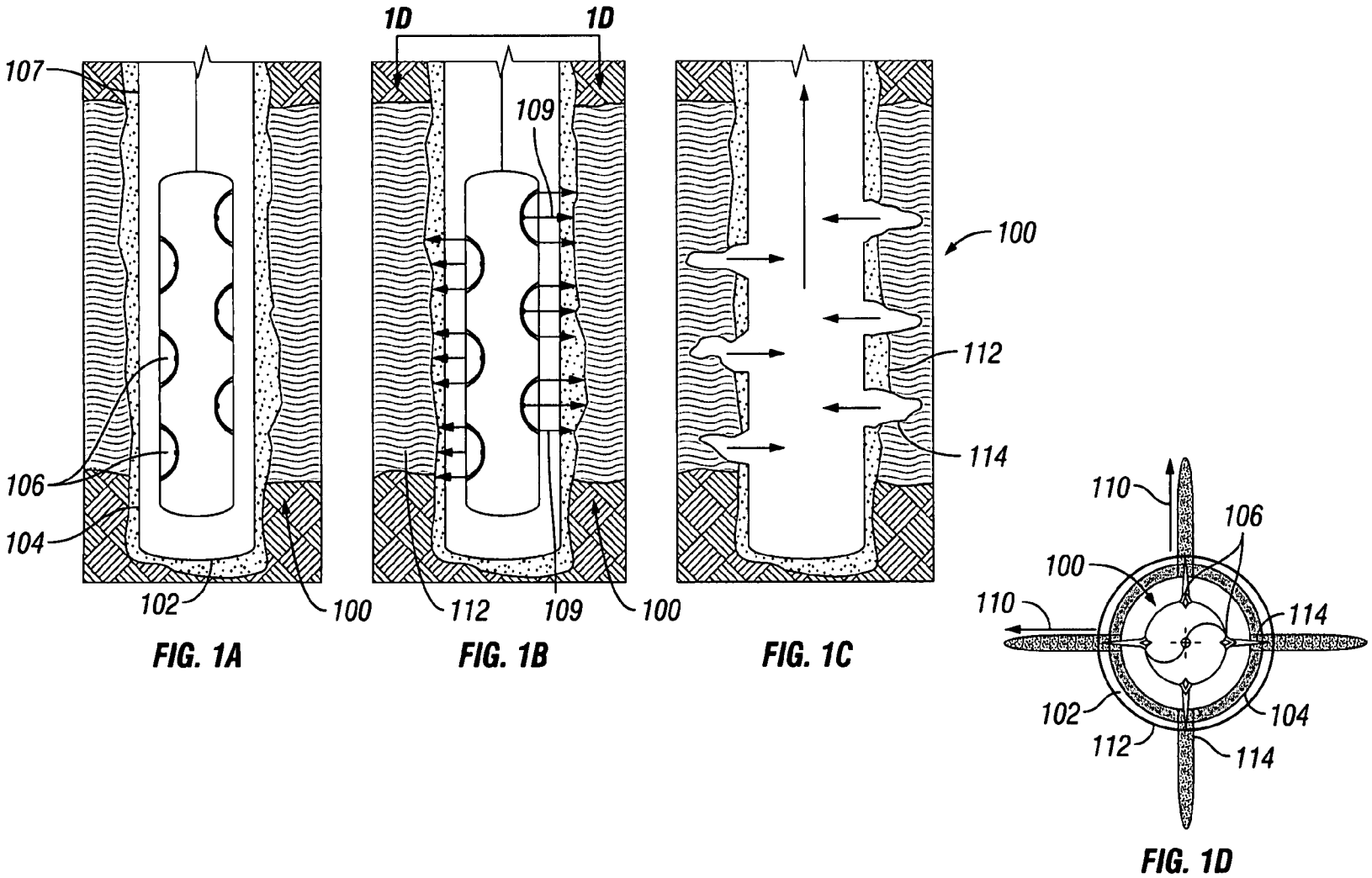
FIGS. 1A, 1B, and 1C show a perspective view of a conventional perforating system.
FIG. 1D shows a downward view of the perforating system shown in FIGS. 1A-1C.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the surface along the wellbore (i.e., into the wellbore), but is meant for illustrative purposes only, and the terms are not meant to limit the disclosure.

Figure 2B:
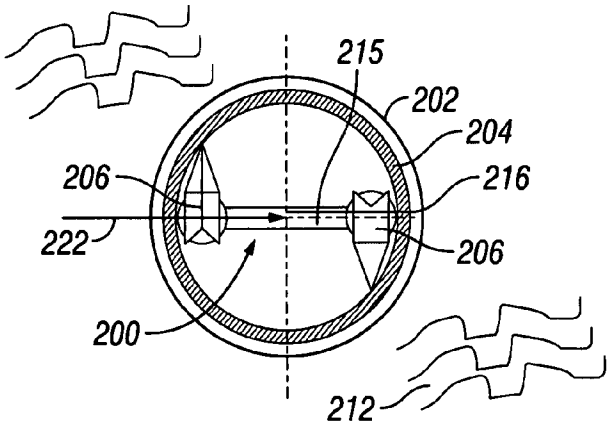
FIGS. 2A and 2B show side perspective views of various configurations of a downhole tool, in accordance with embodiments of the present disclosure.
Figure 2A:
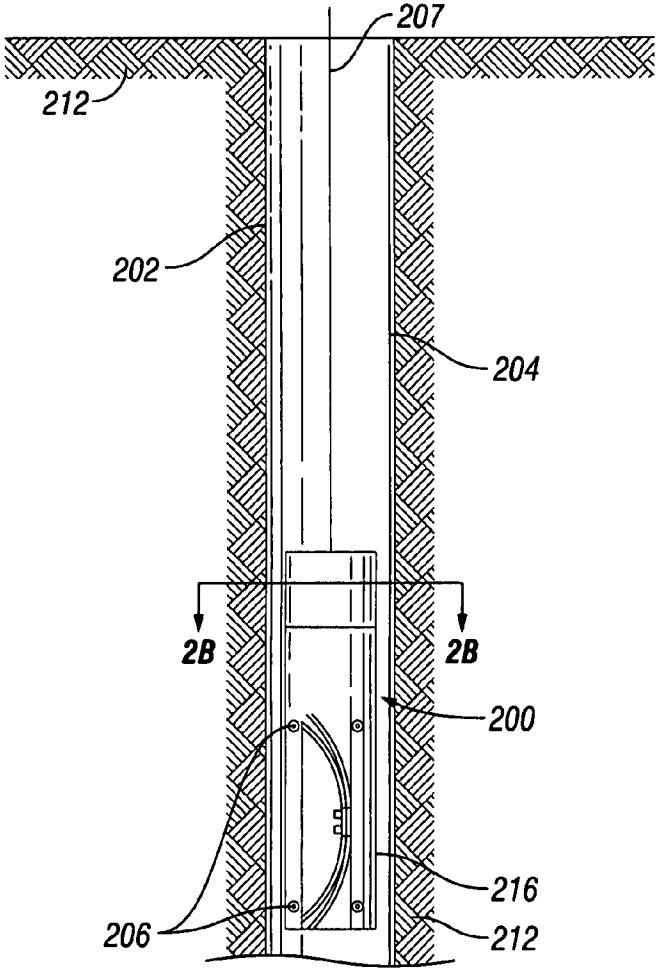

Referring now to FIGS. 2A and 2B, a perspective view of a downhole tool 200 disposed in a wellbore according to embodiments of the present disclosure, is shown. The downhole tool 200 may be disposed in the wellbore 202 and/or a casing string 204, which may be formed within the subterranean formation 212 by conventional means, as would be known to one of skill in the art. The downhole tool 200 may be selectively positioned into the wellbore 202 by way of tubestring 207 (i.e., drillstring, coiled tubing, wireline, etc.).

The downhole tool 200 may include a main body 215, which may be defined by one or more longitudinally extending sides 216. In some embodiments, the main body 215 may have a generally cylindrical shape. The main body 215, and other components associated with downhole tool 200 may be metallic or non-metallic in nature. For example, the main body 215 and/or other components may be made from any hardened steel material, from a durable composite, such as PEEK, or from combinations thereof.

The tool 200 may have one or more perforating charges 206 disposed thereon, which may be configured propel hot fluids or other resultant discharge (not shown) from the tool 200 when the tool 200 is fired. The downhole tool 200 may be positioned near a production zone (not shown) such that perforation of the casing string 204, wellbore 202, and/or the formation 212 may allow hydrocarbonaceous fluids within the production zone to flow from the formation 212 into the wellbore 202.

Referring now to FIGS. 3A-3D, multiple views of various configurations of a downhole tool, is shown. Like the downhole tool 200 previously described, the downhole tool 300 may be positioned within a wellbore 302 at any location as may be desired. The downhole tool 300 may include a main body 315, which may be defined by one or more longitudinally extending sides 316A and/or 316B. The tool 300 may have one or more perforating charges 306 disposed thereon, which may be configured propel or discharge, for example, hot fluids, propellants, etc. from the tool 300 when the tool 300 is fired.

Figure 5:
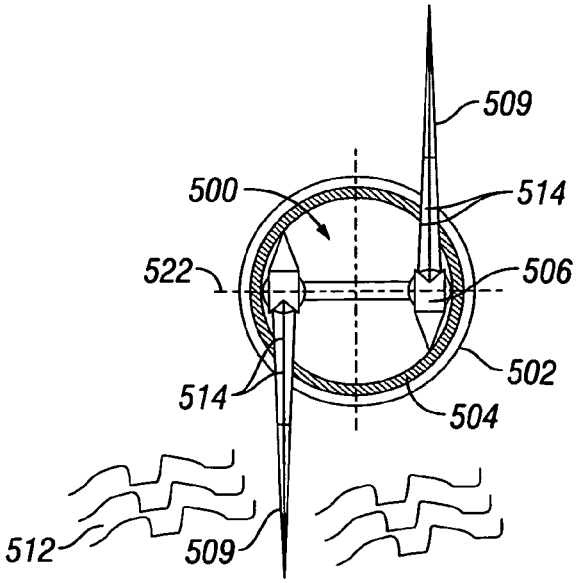
FIG. 5 shows a downward view of a downhole tool forming tangential perforations in a subterranean formation, in accordance with embodiments of the present disclosure.

Referring briefly to FIG. 5, the perforating charges 506 disposed on the tool 500 may be operably configured to fire and propel a resultant discharge 509. The discharge 509 may penetrate entirely through the casing string 504, the wellbore 502 and/or cement (if present), and into the formation 512. In one embodiment, the discharge(s) 509 may penetrate more than 2 to 3 feet into the formation 512.

Referring back to FIGS. 3A and 3B together, there may be a column 381 of charges 306 mounted on one of the sides 316A (or optionally side 316B—not shown) of the tool 300. In this manner, the downhole tool 300 may be configured to fire one or more of the perforating charges 306 in a first firing direction 318. In one embodiment, the downhole tool 300 may be configured such that when one of the perforating charges 306 fires, the resultant force exerted on the sides of the main body 316A and 316B are substantially equal and opposite. Although not illustrated, some of the charges 306 may be multi-directional, such that, for example, one or more of the charges 306 may be configured to fire in two or more directions.

Figure 3B:
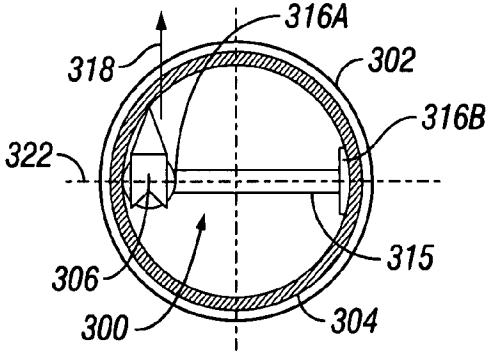
FIGS. 3B and 3D show downward views of the downhole tool depicted in FIGS. 3A and 3C, respectively, in accordance with embodiments of the present disclosure.
Figure 3A:
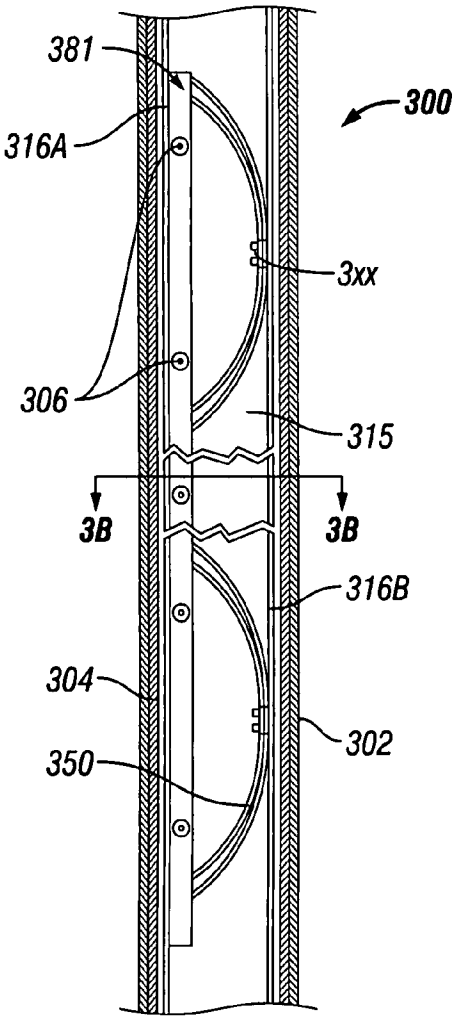
FIGS. 3A and 3C show side perspective views of additional configurations of a downhole tool, in accordance with embodiments of the present disclosure.
Figure 3D:
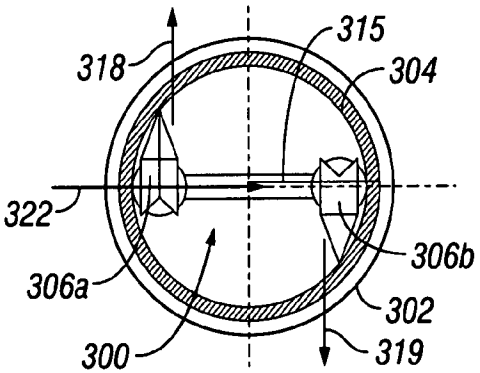
Figure 3C:
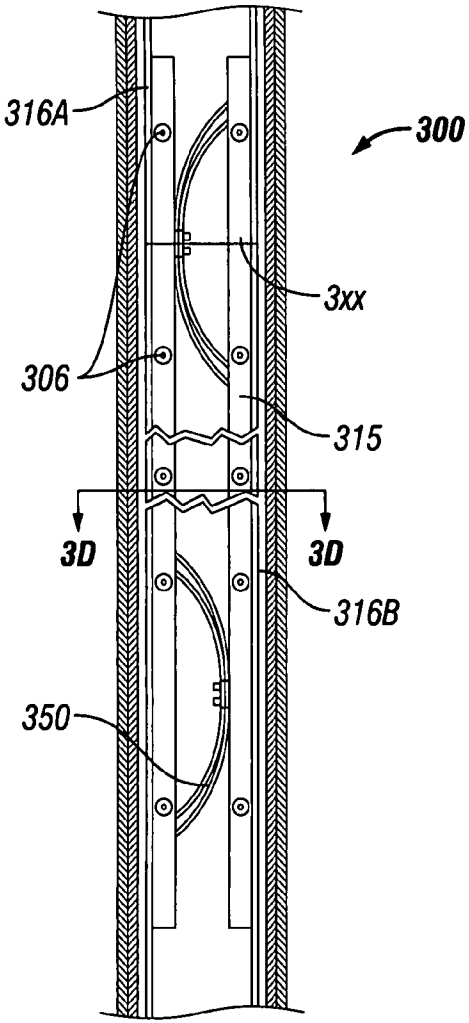

Referring now to FIGS. 3C and 3D together, the downhole tool 300 may be configured to fire one or more of the perforating charges 306 in a first firing direction 318, while one or more of the perforating charges 306 disposed on the second side 316B may fire in a second firing direction 319. As shown by FIG. 3D, the first direction 318 may be in a direction that is generally opposite from the second firing direction 319. However, although not shown in FIG. 3D, it is within the scope of the disclosure that some of the perforating charges 306 may fire such that at least one charge fires in a first direction that is substantially perpendicular to the second direction fired from at least one other charge. In addition, numerous other directional firing relationships are also possible, and are not meant to be limited by the example embodiments described herein.

The downhole tool 300 may be conventionally actuated (i.e., fired) by any triggering means known in the art for actuating a perforating tool, such as a pressure trigger, a wireline trigger, a radio signal trigger, etc. For example, the downhole tool 300 may be actuated by a pressure trigger (not shown) that is triggered in response to an increase in the pressure in a portion of the casing string 304. The charges 306 may also be firingly connected with any type of detonation device, such as a detonating cord 350 shown by FIG. 3C. However, how the charges are fired is not meant to be limited, and as such, any method for firing the charge is applicable to the disclosure.

In one embodiment, the charges 306 may be maintained in ballistic connection by means of the detonating cord 350. The detonating cord 350 may be, for example, any explosive detonating cord that is typically used in oilfield perforating operations. The cord 350 may, for example, provide ballistic transfer between an electronic detonator and a ballistic transfer device, between ballistic transfer devices, between ballistic transfer devices and shaped charges, etc. However, how the charges are fired is not meant to be limited, and other devices or systems may be used to detonate the charges, as would be known to one of ordinary skill in the art.

As previously described, the charges 306 may be disposed on sides 316A and/or 316B. In one embodiment, the charges 306 may be disposed along a lateral axis 322 of the downhole tool 300. One or more charges, which may be a first group of charges 306, may face toward the casing string 304 in a first direction 318, and at least one other charge, which may be a second group of charges, 306 may face toward the casing string 304 in a second direction 319. The first direction 318 and the second direction 319 may be parallel to each other, opposite to each other, perpendicular to each other, or face in any other direction as may be necessary to create cyclonic motion of the fluid within the wellbore 302.

As shown in FIG. 3C, there may be charges 306 mounted on the tool 300 that are spaced directly across from each other. Although not shown, the charges 306 may also be mounted across from each other in an alternating or offset manner. As would be apparent to one of skill in the art, it may be necessary and/or desired to use different charges that are configured to perforate different materials, such as the casing string and/or the formation(s). Thus, the charges 306 may include a first group of charges that are different from a second group of charges, whereby the user may select the group of charges as may be most appropriate for each.

The charges 306 used may be, for example, metallic in nature, and contain pressed explosives and a pressed metal or forged liner, creating a shaped explosive charge, as is typically used in oilfield perforating devices. Upon firing, the charges 306 may form a perforation (e.g., 514, FIG. 5) of any dimension through the material into which the charges 306 are fired. The location of the perforation may be perpendicular or tangential to the surface of the casing 304, or form any other angle thereto. Although not illustrated, it is within the scope of the present disclosure that multiple downhole tools 300 may be operatively connected to and disposed along the tubestring (207, FIG. 2A).

Figure 4B:
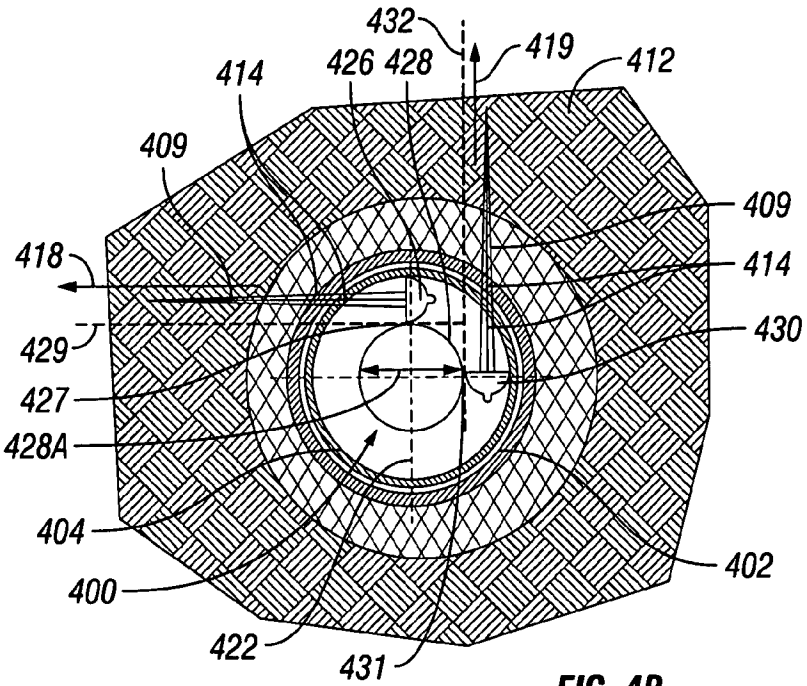
FIGS. 4B and 4D show downward views of the perforating system depicted in FIGS. 4A and 4C, respectively, in accordance with embodiments of the present disclosure.
Figure 4A:
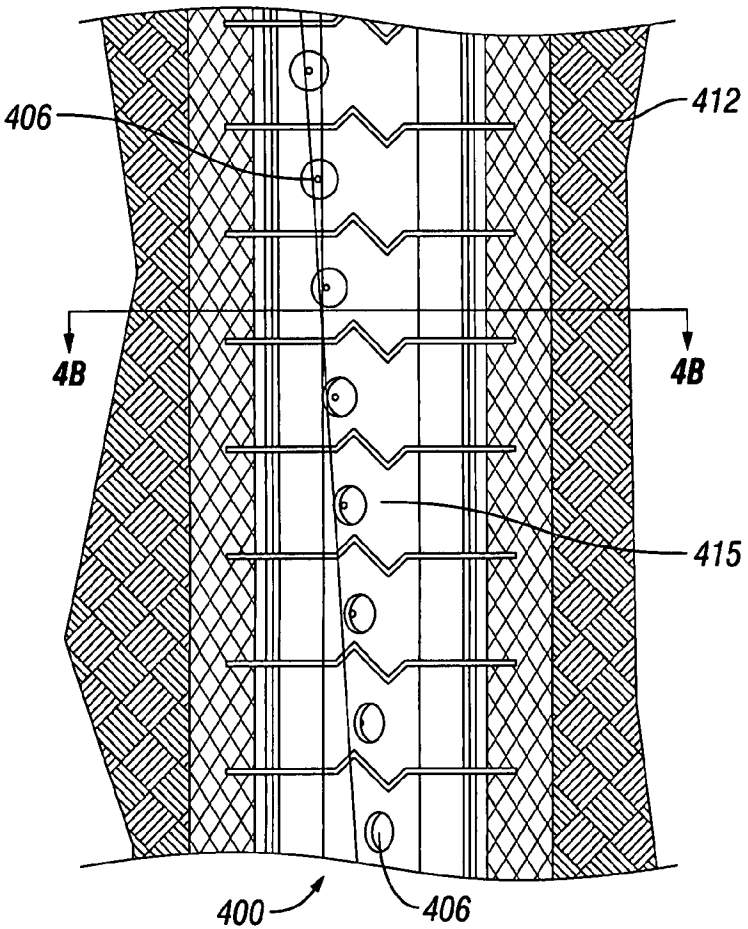
FIGS. 4A and 4C show side perspective views of various configurations of a downhole tool usable in a perforating system, in accordance with embodiments of the present disclosure.

Referring now to FIGS. 4A-4D, a downhole tool 400 usable in a perforation system 401 according to embodiments of the present disclosure, is shown. The perforation system 401, which may be a tangential perforation system, may include a downhole tool 400 usable (i.e., actuatable, fireable, etc.) to perforate a subterranean formation 412. The downhole tool, which may resemble the previously described downhole tools 200 and 300, may include various components, such as one or more charges 406 mounted thereto. FIG. 4B illustrates the tool 400 may have a generally cylindrical shaped main body 415 with a plurality of charges 406 disposed thereon. In one embodiment, the plurality of charges 406 may be mounted on the main body 415 in at least a partial helical pattern.

The charges 406 may include a first perforating charge 426 mounted near a first point 427 on an outer perimeter 428 (or outer diameter 428A) of the downhole tool 400. The first perforating charge 426 may be configured to perforate the subterranean formation 412 in a first direction 418. In one embodiment, the first direction 418 may be in a direction that may be substantially parallel to a first tangent line 429 that bisects the first point 427 on the outer perimeter 428.

The charges 406 may include a second perforating charge 430 mounted near a second point 431 on the outer perimeter 428 of the downhole tool 400. The second perforating charge 430 may be configured to perforate the subterranean formation 412 in a direction that may be substantially parallel to a second tangent line 432 that bisects the second point 431 on the outer perimeter 428.

Thus, one or more of the charges 406 may be fired to create at least one perforation 414 in the subterranean formation 412. The perforation 414 created by the downhole tool 400 may allow subterranean fluids to flow from the formation 412 into the wellbore 402 and/or casing string 404. Production tubing (407, FIG. 4C) may be disposed within the wellbore 402 in order to produce the fluids to the surface. In one embodiment, the perforation(s) 414 may be configured to allow fluids to flow into the wellbore 402 in a cyclonic motion. The induced cyclonic motion, or vortex, may provide the fluid with the ability to separate gases from the subterranean fluids that may be entrained in the liquid phase of the fluids.

Figure 4C:
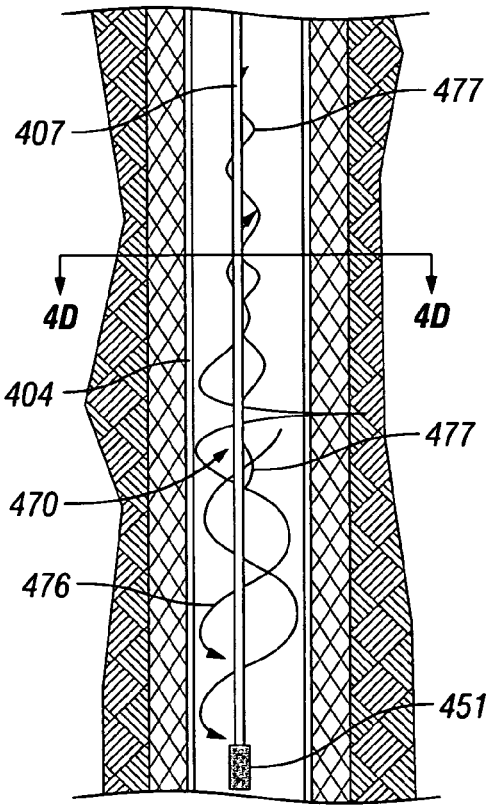
Figure 4D:
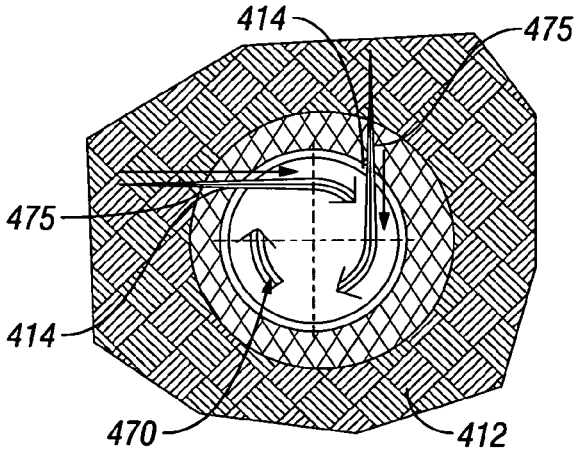

Referring now to FIGS. 4C and 4D together, the downhole tool (400, FIG. 4A) may be fired in order to perforate the casing string 404, the wellbore 402, the formation 412, and/or combinations thereof. Once perforations are created, fluids (i.e., gas phase, liquid phase, two[or more]-phase mixtures, etc.) 475 may flow from the formation 412 and enter into the wellbore 402 via the perforations 414. Because the perforations 414 are formed in a tangentially directed manner, the fluids 475, upon exit from the formation 412, may be have at least a portion of the liquid phase 476 naturally forced to the wall of the casing 404, and at least a portion of the gas phase 477 naturally forced towards the center of the casing 404. The configuration of the perforations 414 in this manner may facilitate a natural separation of the fluids 475 that may make it easier to produce the liquid phase 476.

In addition, with the presence of a gas phase and a liquid phase, the gas phase may have a gas velocity component that adds to the liquid flow entering the wellbore via the perforation(s) 414. The additional velocity may provide additional rotational momentum to the fluids 475 as the fluids enter the wellbore 402. To facilitate production of the heavier liquid phase to the surface, there may be an electric submersible pump (ESP) 451 disposed in the wellbore 402. The ESP 451 may be any ESP as known to one of ordinary skill in the art. For example, the ESP 451 may be the ESP described by U.S. Pat. No. 5,845,709, incorporated by reference herein in entirety. With sufficient separation of the fluids, the pump 451 may be used to produce liquids to a surface facility (not shown) that is substantially devoid of any entrained gas.

A vortex may be any circular or rotary flow related to an amount of circulation or rotation of a fluid. In fluid dynamics, the movement of a fluid may be said to be cyclonic if the fluid moves around (e.g., rotates, spins, etc.) some axis in a circle, helix, cyclone, etc. Thus, once the tool 400 is fired, the system may use rotational effects and gravity to separate mixtures of fluids 475, without the need for centrifuges, filters, or other mechanical/downhole devices.

In creating the cyclonic motion, a high rotating speed may be established within the wellbore (or casing), whereby formation fluids may flow in a spiral pattern, such that natural separation of the liquid phase and the gas phase may occur. Physically, the larger (i.e., denser) liquid molecules flowing into the wellbore 402 have sufficient inertia to move toward the casing wall, whereby gravity subsequently causes the liquid molecules to fall toward the bottom of the wellbore 402. As the cyclonic movement of fluid is essentially a two phase particle-fluid system, fluid mechanics and particle transport equations may be used to describe the behavior of the separation, as would be known to one of skill in the art.

In general, centrifugal separation of fluids/solids different densities is known in the art, and basic physics shows that the force on an object in circular (Fc) motion is a function of rotational velocity (omega ω) the mass (M) and the radius (r), as illustrated by the equation $Fc=\omega^2 \cdot m \cdot r$. Accordingly, the rotation of a fluid column may cause the liquid to move outward, towards the wall. The weight of the liquid may cause the liquid phase to sink downwards in the rotating column of fluid. Conversely, the gas phase in column may progress towards the center, and buoyancy of the gas may cause the gas to rise towards the surface.

Referring again to FIGS. 4A and 4B together, the downhole tool 400 may include at least one perforating charge 406 mounted along a lateral axis 422 of the downhole tool 400. In an embodiment, the at least one perforating charge 406 may be configured to perforate the subterranean formation 412 in a first direction 418 that may be substantially perpendicular to the lateral axis 422. The at least one perforating charge 406 may be mounted near an outer perimeter 428 (or alternatively outer diameter 428A) of the downhole tool 400. In addition, there may be at least a second perforating charge 430 mounted near the outer perimeter 428 of the downhole tool 400. In one embodiment, the at least a second perforating charge 430 may be configured to perforate the subterranean formation 412 in a direction that is opposite [i.e., substantially 180 degrees] from the perforating direction of the at least one perforating charge 426 (see FIG. 5).

The downhole tool 400 is not limited to any particular number of perforating charges 406. In some embodiments, the there may be a plurality of additional perforating charges. In further embodiments, each of the plurality of additional perforating charges may be configured to perforate the subterranean formation in a direction(s) of corresponding tangent lines that bisect corresponding points on a wellbore disposed in the subterranean formation.

Embodiments disclosed herein may provide for a method of operation that includes separating a gas phase from a liquid phase of hydrocarbonaceous fluids produced from a subterranean formation. The method may provide for separation of the fluids while the fluids are within the wellbore. The method may include the steps of positioning a downhole tool in a wellbore, and operating or firing the downhole tool in order to form perforations in the subterranean formation. The perforations may be formed in a manner that creates or provides for a circular, cyclonic motion from fluids that exit the subterranean formation and enter the wellbore through the perforations. The fluids may be hydrocarbonaceous fluids that include a gas phase and a liquid phase. The method may include the step of producing the liquid phase to the surface, wherein the liquid phase may be substantially devoid of the gas phase as a result of the separation that occurs in the fluids in the wellbore. In some embodiments, at least one perforation may be formed in a direction that is substantially parallel to a tangent line that bisects a point on a wall of the wellbore.

Other aspects of the method may include securing the downhole tool in a fixed position relative to a casing string disposed in the wellbore, and the casing string may include a phase separation section configured for the gas phase and the liquid phase to substantially separate from each other. A subermissble pump, such as pump 45, may be used to produce the liquid phase to the surface after the gas phase has substantially separated therefrom.

Embodiments of the present disclosure may also provide for a method of perforating a subterranean formation that includes various steps, such as positioning a downhole tool in a wellbore, operating the downhole tool to perforate the subterranean formation, forming the perforations in a manner that creates a natural cyclonic motion as a result of the momentum of the fluid as the fluid exist the subterranean formation and enter the wellbore through the perforations, whereby the fluid comprises a gas phase and a liquid phase, and producing the liquid phase to the surface, such that the liquid phase is substantially devoid of the gas phase. In one embodiment, the method may include at least one perforation formed in a direction that is substantially parallel to a tangent line that bisects a point on a wall of the wellbore.

In other aspects, the method may include securing the downhole tool in a fixed position relative to a casing string disposed in the wellbore, whereby the casing string comprises a phase separation section configured for the gas phase and the liquid phase to substantially separate from each other, as well as using a submersible pump to produce the liquid phase to the surface after the gas phase has substantially separated therefrom.

The present disclosure may advantageously use a natural physical separation as result of the perforation pattern created by the downhole tool 400. The use of tangential perforations through a production zone may advantageously promote or enhance extra separation of fluids, whereby a resultant liquid phase is readily and easily produced to the surface. Embodiments disclosed herein advantageously do not require extra parts and/or maintenance in order to keep the separation ongoing.

Cyclonic motion may advantageously induce (i.e., facilitate, etc.) separation of a liquid phase from a gas phase. This separation occurs as a result of physics, whereby the liquid phase may move to the outside of the fluid flow, and may also start moving downwardly in the wellbore, such as towards a pump. As such, the gas phase may beneficially collect towards the center, form larger bubbles, and flow easily on up through the casing.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of perforating a subterranean formation, the method comprising:

positioning a downhole tool in a wellbore;

operating the downhole tool to perforate the subterranean formation;

forming the perforations in a manner that creates a natural cyclonic motion as a result of the momentum of the fluid as the fluid exits the subterranean formation and enters the wellbore through the perforations, wherein the fluid comprises a gas phase and a liquid phase;

operating a downhole pump disposed below the downhole tool, wherein the cyclonic motion creates natural separation of the gas phase from the liquid phase and wherein the downhole pump produces the liquid phase to the surface, wherein the liquid phase has a diminished gas content due to the phase separation.

2. The method of claim 1, wherein at least one perforation is formed in a direction that is substantially parallel to a tangent line that bisects a point on a wall of the wellbore.

3. The method of claim 1, wherein the downhole tool is secured in a fixed position relative to a casing string disposed in the wellbore, wherein the casing string comprises a phase separation section configured for the gas phase and the liquid phase to substantially separate from each other.

4. A tangential perforation system for perforating a subterranean formation, the system comprising:

a wellbore disposed in the subterranean formation;

a downhole tool positioned within the wellbore, the downhole tool further comprising a first perforating charge mounted near a first point on an outer perimeter of the downhole tool, wherein the first perforating charge is configured to perforate a subterranean formation in a direction that is substantially parallel to a first tangent line that bisects the first point on the outer perimeter, and wherein perforation of the subterranean formation causes subterranean fluids to enter the casing string in a cyclonic motion, and wherein the subterranean fluids comprise a gas entrained in a liquid; and a downhole pump disposed below the downhole tool wherein the cyclonic motion creates natural separation of the gas from the liquid, and wherein the downhole pump produces the liquid to the surface, wherein the liquid has a diminished gas content due to the phase separation.

5. The tangential perforation system of claim 4, the system further comprising a casing string disposed within the wellbore, the casing string comprising an inner diameter, wherein the downhole tool is positioned within the casing string, and wherein the at least one perforating charge is configured to perforate the casing string in a direction that is substantially parallel to the first tangent line.

6. A tangential perforation system for perforating a subterranean formation, the system comprising:

a wellbore;

a downhole tool positioned within the wellbore, the downhole tool further comprising at least one perforating charge mounted along a lateral axis of the downhole tool, wherein the at least one perforating charge is configured to perforate the wellbore and the subterranean formation in a direction that is substantially perpendicular to the lateral axis, wherein perforation of the subterranean formation causes subterranean fluids to enter the casing string in a cyclonic motion, and wherein the subterranean fluids comprise a gas entrained in a liquid;

a downhole pump disposed below the downhole tool, wherein the cyclonic motion creates natural separation of the gas from the liquid, and wherein the downhole pump produces the liquid phase to the surface, wherein the liquid phase has a diminished gas content due to the phase separation.

7. The tangential perforation system of claim 6, the system further comprising a casing string disposed within the wellbore, the casing string comprising an inner diameter, wherein the downhole tool is positioned within the casing string, and wherein the at least one perforating charge is configured to perforate the casing string in the direction that is substantially perpendicular to the lateral axis.

8. The tangential perforation system of claim 6, wherein the downhole tool further comprises at least a second perforating charge mounted near an outer perimeter of the downhole tool, wherein the at least a second perforating charge is configured to perforate the casing in a direction that is opposite from the at least one perforating charge.

9. The tangential perforation system of claim 6, the system further comprising a point on the inner diameter of the casing string, wherein the perforating charge is also configured to perforate the formation in a direction that is substantially parallel to a line that bisects the point.

* * * * *